US006545251B2

(12) United States Patent
Allera et al.

(10) Patent No.: US 6,545,251 B2
(45) Date of Patent: Apr. 8, 2003

(54) COOKING OVEN

(75) Inventors: Riccardo Allera, Laveno Mombello (IT); Giovanni Franzetti, Ispra (IT); Marco Maritan, Viggiu (IT); Salvatore Sanna, Cassinetta di Biandronno (IT); Massimo Maroni, Olgiate Olona (IT); David Ward, Milan (IT); Galli Rocco, Travedona Monate (IT); Ermanno Buzzi, Varese (IT); Massimiliano Comolli, Varese (IT); Robert Meyer, Coloma, MI (US); Marco Poma, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/043,967

(22) Filed: Oct. 26, 2001

(65) Prior Publication Data

US 2002/0060215 A1 May 23, 2002

(51) Int. Cl.[7] ..... A21B 1/14; A21B 1/26; A21B 1/50; A21B 1/22

(52) U.S. Cl. ..... 219/394; 219/406; 219/407; 219/395; 219/398; 219/400; 126/339

(58) Field of Search ..... 219/394, 395, 219/398, 406–409, 400; 126/339

(56) References Cited

U.S. PATENT DOCUMENTS

| | | | | | |
|---|---|---|---|---|---|
| 2,994,760 | A | | 8/1961 | Pecoraro et al. | |
| 3,143,638 | A | | 8/1964 | Scott | |
| 3,176,118 | A | | 3/1965 | Scott | |
| 3,241,543 | A | | 3/1966 | Hirsch | |
| 3,241,545 | A | | 3/1966 | Reinert et al. | |
| 3,548,154 | A | | 12/1970 | Christianeson | 219/403 |
| 4,020,323 | A | | 4/1977 | Dills | 219/405 |
| 4,215,266 | A | | 7/1980 | Smith et al. | 219/413 |
| 4,585,923 | A | * | 4/1986 | Binder | 219/400 |
| 4,780,597 | A | | 10/1988 | Linhart et al. | 219/404 |
| 4,960,977 | A | * | 10/1990 | Alden | 219/388 |
| 5,616,266 | A | * | 4/1997 | Cooper | 219/407 |
| 5,618,458 | A | | 4/1997 | Thomas | 219/394 |
| 5,796,082 | A | * | 8/1998 | Kim | 126/339 |
| 6,114,664 | A | * | 9/2000 | Cook et al. | 219/400 |
| 6,376,817 | B1 | * | 4/2002 | McFadden et al. | 219/681 |

FOREIGN PATENT DOCUMENTS

| | | | |
|---|---|---|---|
| DE | 8508617u | 5/1985 | F24C/15/16 |
| DE | 8508617 | 11/1993 | F24C/15/16 |
| EP | 0253278 A | 1/1988 | F24C/15/16 |
| GB | 2152790 SA | 7/1985 | H05B/6/64 |
| GB | 2152790 A | 8/1985 | H05B/6/64 |
| GB | 2267339 A | 12/1993 | F24C/15/16 |
| GB | 2289329 | 12/1998 | |
| NL | 8104739 | 5/1983 | F24C/7/06 |

* cited by examiner

*Primary Examiner*—Joseph Pelham
(74) *Attorney, Agent, or Firm*—Thomas J. Roth; Robert O. Rice; John F. Colligan

(57) ABSTRACT

A cooking oven comprises a cavity having a separating and insulating plate which can be inserted horizontally in the cavity in order to split it in two sub-cavities. Each sub-cavity has heating elements on its side walls. The oven sub-cavities can be singularly or separately and this increases flexibility in use.

25 Claims, 8 Drawing Sheets

COOKING OVEN

BACKGROUND OF THE INVENTION

1. Field of the Invention

The present invention relates to a cooking oven, and in particular to a cooking appliance incorporating a single or dual oven cavity oven with a flexible heating system.

2. Description of the Related Art

It is well known that energy saving is an imperative for all the devices which consume energy and therefore contribute to environment pollution and/or greenhouse effect. This applies to domestic appliances, and particularly to domestic appliances using high level of energy like electric cooking ovens.

In the past, there have been attempts to improve oven efficiency and flexibility by providing removable partitions for oven cavities such that the oven may operate in a single cavity or a dual cavity configuration. U.S. Pat. No. 5,618,458 discloses an oven cavity into which food to be cooked can be placed, and a partition received within the cavity to divide the cavity into a plurality of cooking spaces. U.S. Pat. No. 4,780,597 discloses an oven with insertable partitions wherein the partitions carry heating elements.

It is an object of the present invention to provide an oven with a cavity that. improves oven performance (efficiency and effectiveness), provides greater flexibility in use, improved quality of cooking and better cleanability by means of a flexible heating system.

SUMMARY OF THE INVENTION

According to the invention, the oven comprises heating elements placed vertically on side walls of the cavity, in lieu of or in addition to traditional heating elements placed horizontally on top, bottom and rear walls. The concept is applicable to pyrolitic and non-pyrolitic ovens, and includes also the solution according to which the oven cavity does not have the traditional heating elements placed horizontally on top and/or bottom walls and/or the solution according to which the oven cavity is provided, on its back wall, with a traditional central forced air fan and a tubular heater or quartz lamp.

The use of the separating and insulating plate and of the heating elements according to the invention allows improved energy efficiency due to flexibility in use and optimization of heat transfer. Moreover it reduces cooking cycle times (effectiveness) due to smaller cavity and improved energy efficiency. The oven cavities of the oven according to the present invention can be run in static and convective modes singularly or separately. This increases flexibility in use. The reduced dimension of the sub-cavities and/or the use of heating elements placed on side walls of the cavity improve temperature uniformity in the cavity.

According to a first embodiment of the invention, four heating elements, two for each side of the oven cavity, are housed in suitable metal casings or 'pockets' that are attached to the internal face of the cavity wall.

According to a second embodiment of the invention, four tubular heating elements, two for each side of the oven cavity, are housed in suitable metal casings or 'pockets' that are attached to the external face of the cavity wall.

According to a third embodiment of the invention, four radiant heating elements are mounted directly behind the walls of the oven cavity. In such embodiment the oven cavity can be provided with openings closed by glass ceramic plates or metal plates that cover the heater elements.

According to a fourth embodiment of the invention, a twin radiant heating element is mounted behind the metal side wall or behind a metallic or glass ceramic plate and is located at the center of each side wall of the oven. In this case the heaters are aligned so as to transfer heat also to the faces of the separating and insulating plate, underneath the food tray or container as well as to the cavity. The scope here is to improve baking performance especially in terms of browning, crisping etc. through the use of appropriate reflection.

According to a fifth embodiment of the invention, four radiant heating elements in the form of quartz lamps, two for each side of the oven cavity are used. These are housed in suitable metal reflectors that are attached to the external face of the cavity wall and covered either by a metal plate (which can be integral with the oven wall) or by ceramic glass.

According to a sixth embodiment of the present invention, the oven comprises a forced air fan and a heater for the main cavity and upper sub-cavity and two quartz lamps for the lower sub-cavity only. The heater can be a circular tubular heater or a quartz lamp.

According to an seventh embodiment of the invention, the inclusion of a rotating table on the separating plate improves browning, crisping, heat distribution and hence improves efficiency (time and energy saving) and effectiveness (cooking results).

The walls of the oven cavity, of the oven door or accessories thereof (e.g. baking tray) are preferably coated with coatings including fluoropolymers with or without PTFE additives and fillers, Sol-Gel generated films and PECVD (Plasma Enhanced Chemical Vapor Deposition) generated films. All the above coatings have the specific intent to create an abrasive-corrosive resistant and non-stick surface applied to metallic (e.g.. stainless steel) or non metallic (e.g. enamel) substrate. These coatings can be applied to all or part of the cavity or oven accessories or parts e.g. baking trays, oven door, racks etc. The coatings can be applied to sheet, pre-formed sheet or ready-to-use parts.

The separating and insulating plate may be made of a material different from metal, i.e. polymeric material (preferably silicone resin type), tempered glass and Pyrex™ glass. The separating and insulating plate may also include a series of indications and/or guides (e.g. pressed/molded directly in the plate material) to help the consumer position the food tray or container correctly. Further indications such as "Danger hot surface" or "Danger heavy weight" can also be added.

When installed, the separating plate sits on side supports that also act as heat and odor barriers around the perimeter of the cavity.

When tempered or Pyrex™ type glass is used for the separating plate, visibility inside the cavity is greatly improved, although in this case thermal insulation is reduced. In order to improve thermal insulation, the glass separating plate may have an interspace in which vacuum is created. Visibility is further improved by using low voltage (24 V) or high (220 V) voltage, low (10–50 W) wattage, halogen illumination devices in both sub-cavities. These can be positioned on any of the cavity walls although the preferred position is either at the rear of the cavity or on the side walls.

High temperature silicone resin plastic may also be used to realise all or part of the separator; in this particular case the plastic must be suitable up to 500° C. continuous use i.e. also for pyrolitic ovens.

BRIEF DESCRIPTION OF THE DRAWINGS

The present invention will be disclosed in detail with reference to the accompanying drawings, which illustrate preferred embodiments of the invention by way of example and in which.

DESCRIPTION OF THE PREFERRED EMBODIMENT

Figure 1:
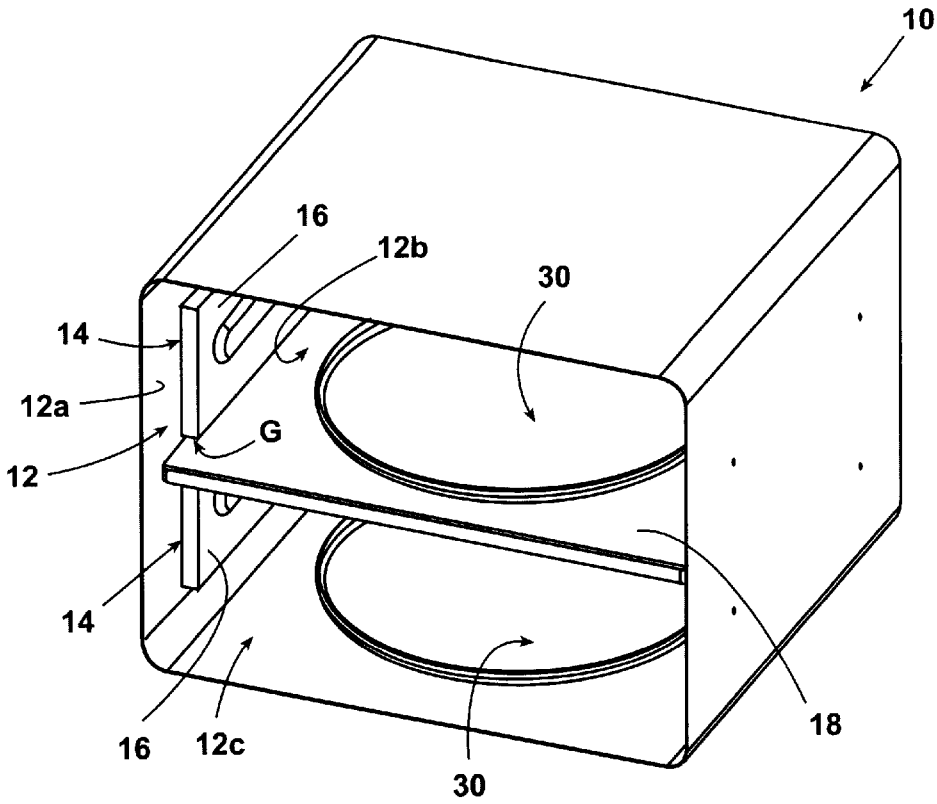
FIG. 1 is a perspective view of a built-in oven according to the invention, in which the door oven and insulating panels have been removed for sake of clarity.

With reference to the drawings, an oven 10 comprises a cavity 12 having four heating elements 14, two for each side 12*a* of the oven cavity, which are housed in flat plates 16. According to the embodiment shown in FIGS. 1–3, two flat plates 16 are located at each side 12*a* of the cavity and connected electrically through the back plate of the oven. The flat plates 16 are vertically separated in order to form an horizontal slot or guide G in which is slidably inserted a shelf-shaped separating plate 18 that splits the cavity 12 in two sub-cavities 12*b* and 12*c*. The separating plate 18 has thermal insulating properties and is provided with a silicone seal (not shown) in the front portion thereof in order to seal the front wall of the cavity i.e. the oven door.

Each flat plate 16 consists preferably of a tubular resistance element 13 cast in a suitably shaped light alloy e.g. aluminum.

Figure 3:
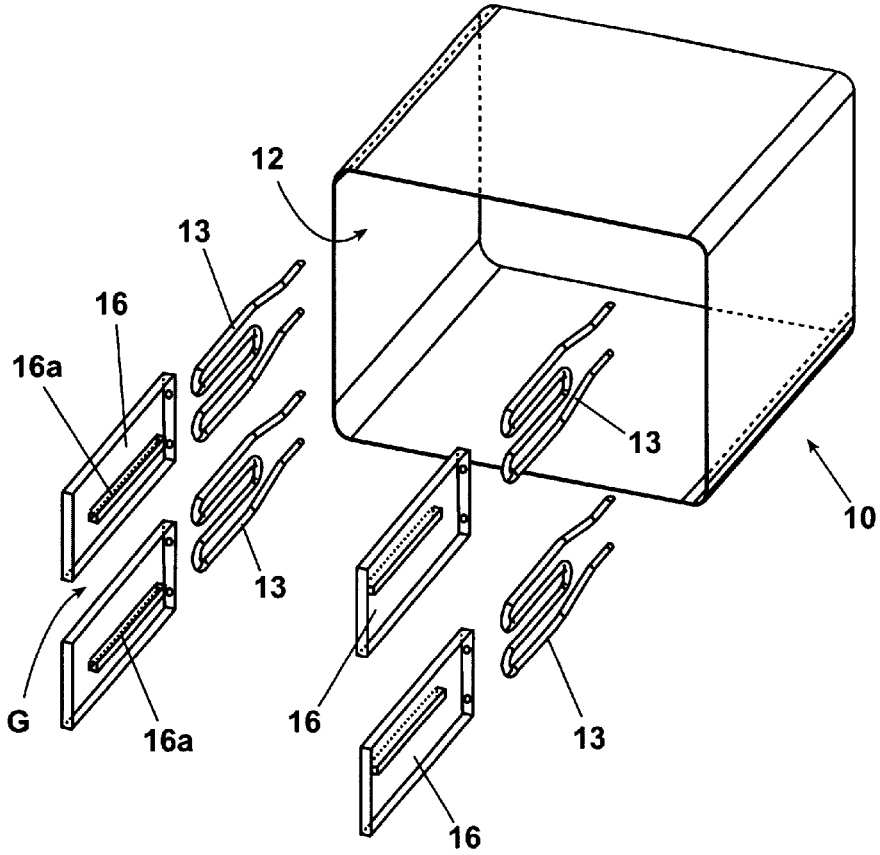
FIG. 3 is an exploded view of the oven of FIG. 1 in order to show details of heating elements according to a first embodiment of the invention.

As an alternative solution, as shown in FIG. 3, each flat heating element 14 can consist of a tubular resistance element 13 clamped to a suitably shaped thin metallic (e.g. steel) plate 16. Each metallic plate 16 has a horizontal central ridge 16*a* which is used for slidably supporting food trays or grills.

Figure 4:
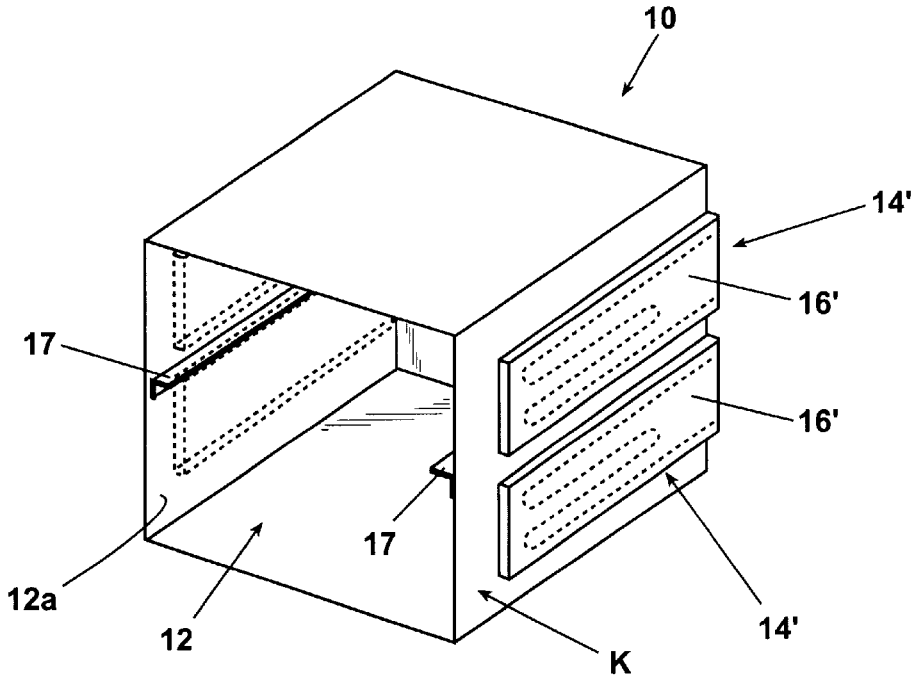
FIG. 4 is a perspective view of the oven according to a second embodiment of the invention in which the oven door, insulating panels and the separating plate have been removed for sake of clarity.
Figure 5:
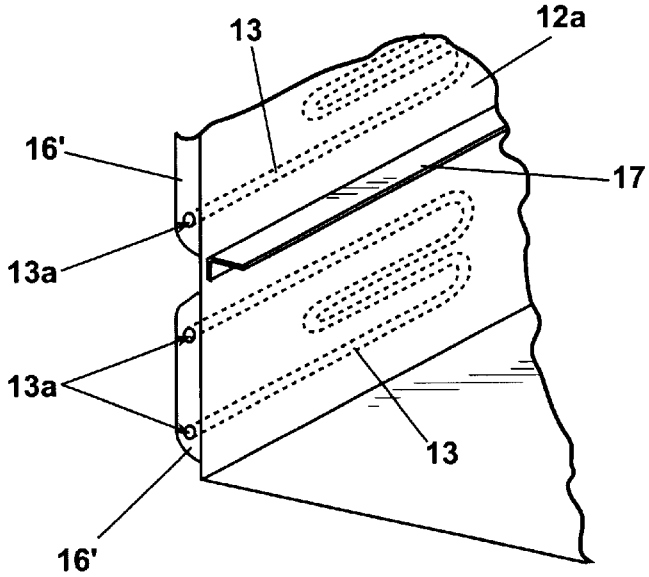
FIG. 5 is a detailed view of a portion of the left side wall of the oven according to FIG. 4.

According to a second embodiment of the invention, shown in FIGS. 4–5, flat plates or housings 16' of heating elements 14' are located on the external face K of the cavity 12 at each side 12*a* of the cavity and connected electrically through the back plate of the oven. The flat housings 16' are vertically separated in order to provide a thermal insulation between them. The sides 12*a* of the cavity are provided with rails 17 for supporting the separating plate 18 and are provided with ridges (not shown) for slidably supporting food trays or grills.

Figure 6:
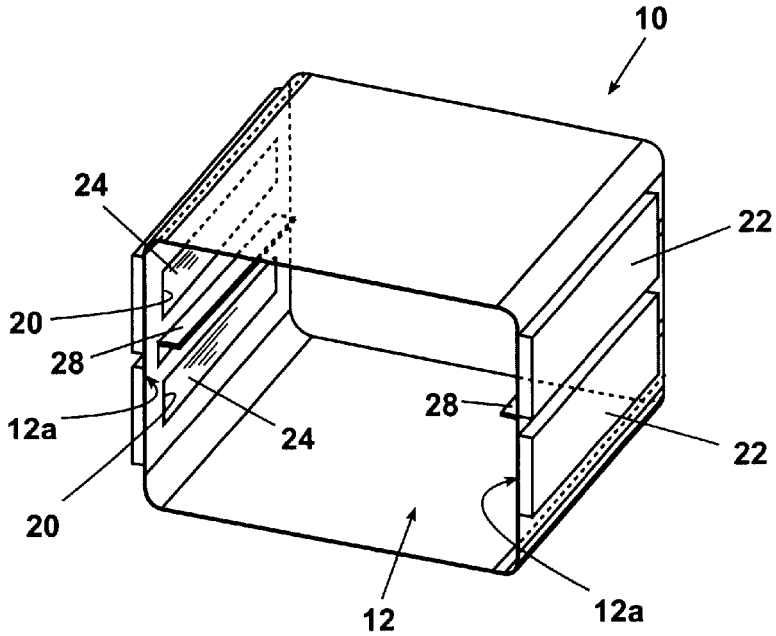
FIG. 6 is a perspective view of the oven according to a third embodiment of the invention.
Figure 7:
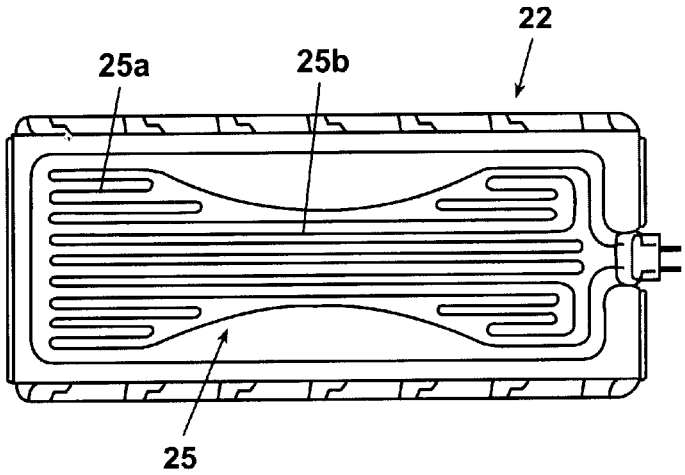
FIG. 7 is a detail showing the layout of the heater used in the heating elements of the oven shown in FIG. 6.

According to a third embodiment of the invention, shown in FIGS. 6–7, the oven cavity 12 comprises four rectangular openings 20 on its side walls in which radiant heating elements or heaters 22 are placed, two for each side. In front of each element there is a dark Ceran® glass cover 24 fitted so as to protect the heater ribbon 25 from the splattering of food etc. and also filters both visible and I.R. heat. The heaters 22 are mounted flush to the cavity wall and are therefore installed on the outside of the cavity 12. Heat is therefore transmitted from the heater to/through the glass 24 and then into the cavity 12 via radiation and convection. Some conduction is also afforded from the glass to part of the cavity side wall 12*a*. The separating plate 18 is supported by L-shaped rails 28 fixed to the side wall 12*a* of the cavity 12 between each couple of openings 20.

The radiant heating element 22 may include a heater ribbon layout which is optimized to improve heat distribution in the cavity and thus cooking performance as shown in FIG. 7. The shape of the ribbon 25 is similar to a "dickey bow" in which the heat distributed is favored towards the edges 25*a* (more exposed ribbon area) rather than center 25*b* (less exposed ribbon area). Instead of using a plurality of glass covers 24, it is possible to use metal plates (not shown) made of a material which optimizes the heat transfer through the plates. The plates may also be integral with the metal wall of the oven cavity.

In any of the above embodiments the installed power for each side wall heater is preferably between 250 W to 1500 W. This power is added to the power of standard grill and lower heating elements.

Figure 8:
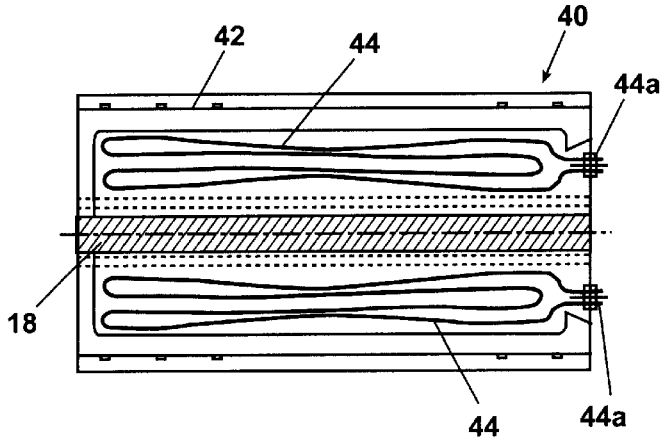
FIG. 8 is a detail showing the layout of a twin heater similar to the one shown in FIG. 7.
Figure 9:
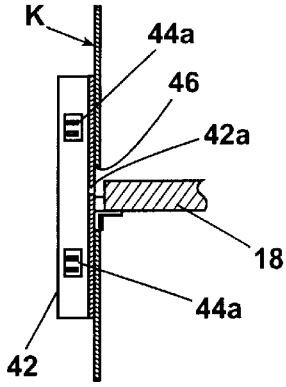
FIG. 9 is a cross-section of an oven provided with the heating element of FIG. 8.

According to a further embodiment of the invention, shown in FIGS. 8–9, each heating element is a twin radiant heating element 40 comprising a metal flat housing 42 containing two dickey bow shaped heating elements 44 each having electrical connections 44*a* on the rear wall of the oven. Each twin radiant element 40 is attached to the center of the oven side wall, which can be provided with a longitudinal slot 46 in order to improve the heat transfer to the separating plate 18. A metallic or a ceramic glass plate 42*a* can close the face of the housing 42 towards the external face K of the side wall. In the second case (not shown), the slot 46 is an opening having the same dimension of the ceramic glass plate.

Figure 11:
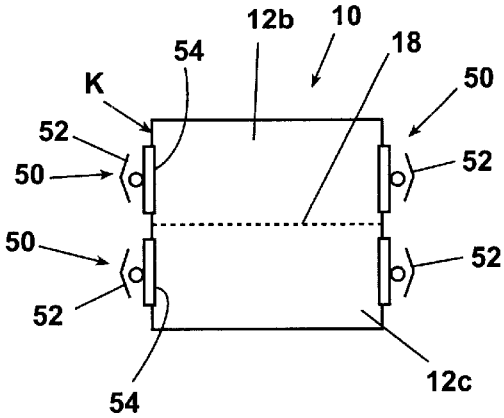
FIGS. 11–14 are schematic front views of an oven according to further embodiments of the present invention.

According to a further embodiment of the invention, shown in FIG. 11, the oven comprises four radiant heating elements in the form of quartz lamps 50, two for each side of the oven cavity 12. These are housed in suitable metal reflectors 52 that are attached to the external face K of the cavity wall and covered either by a metal plate or ceramic glass 54.

Figure 12:
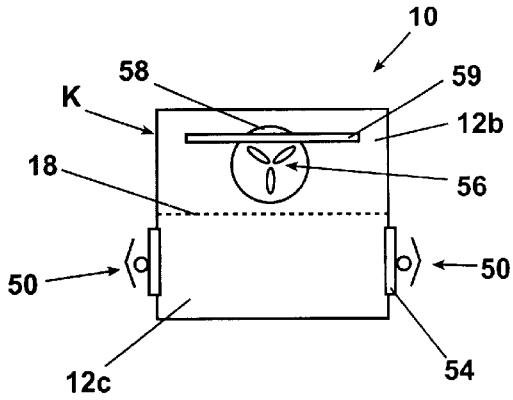

According to a further embodiment of the invention, shown in FIG. 12, the oven 10 comprises a forced air fan 56 and circular heater 58 for the main cavity 12 and upper sub-cavity 12*b* and two quartz lamps 50 for the lower sub-cavity 12*c* only. Instead of or in addition to the circular heater 58, a radiant heater such as a quartz lamp 59 can be used. A grill type heater (not shown) may also be provided along the upper portion of the cavity 12. Moreover, the fan 56 may be centrally located in the back wall such that a portion of the fan extends above the partition 18 and a portion below the partition 18. In such a configuration, the partition may be formed with an indented or notched portion along its rear edge.

Figure 13:
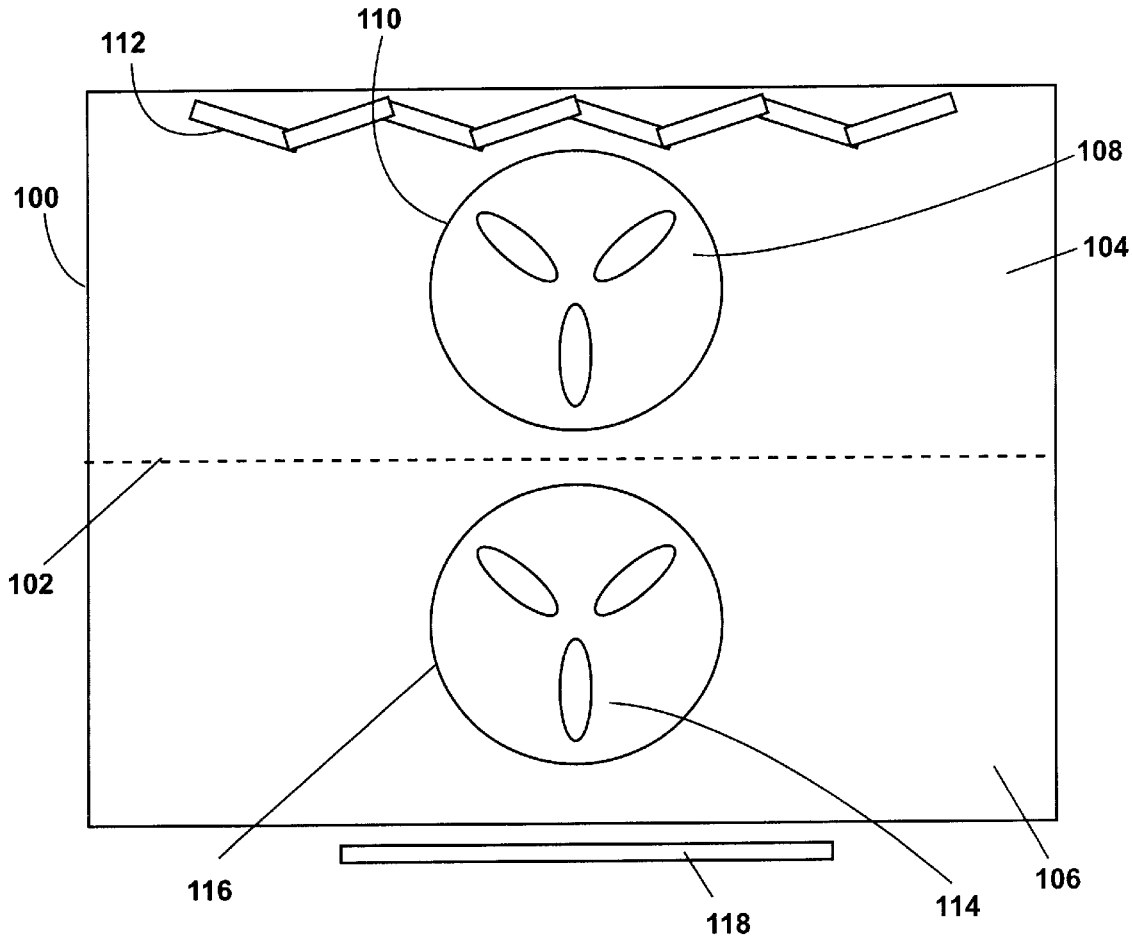

Turning now to FIG. 13, another embodiment of the present invention is disclosed. In this configuration, a main cavity 100 is capable of receiving an insertable partition 102 for separating the main cavity 100 into an upper sub-cavity 104 and a lower sub-cavity 106. Along the rear wall of the upper sub-cavity 104 is a forced air fan 108 surrounded by a circular heater 110. An upper grill element 112 may also be provided. The lower sub-cavity 104 also includes a forced air fan 114 along the rear wall wherein the fan 114 is surrounded by a circular heater 116. A bottom heater 118 may also be provided.

Figure 14:
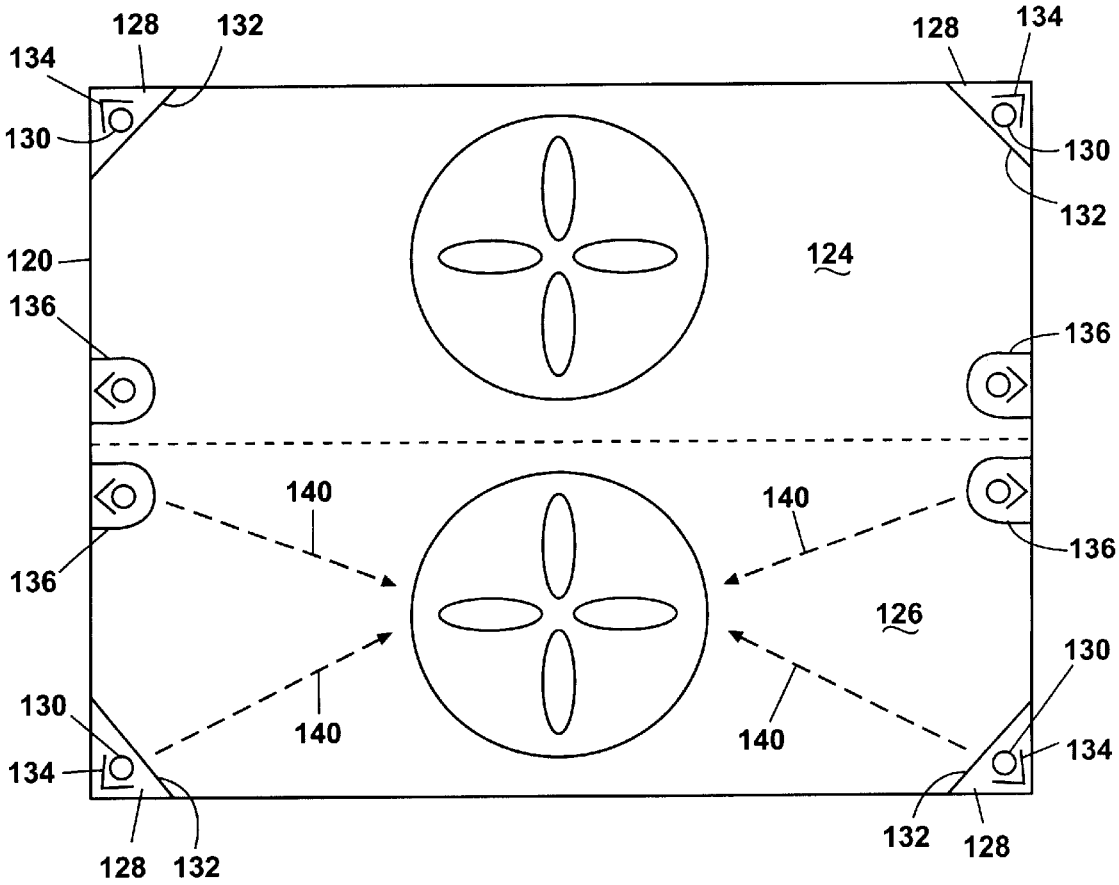

FIG. 14 illustrates yet another embodiment of the present invention. In this embodiment a main cavity 120 is capable of receiving an insertable partition 122 for separating the main cavity 120 into an upper sub-cavity 124 and a lower sub-cavity 126. The main cavity 120 includes a top wall, a bottom wall and a pair of side walls wherein at each corner is positioned a radiant heater 128. Each radiant heat element 128 may include a radiant lamp 130 position behind a protective glass lens 132 such as Ceran® glass. A reflective surface 134 is position behind the lamp 130 to direct radiant energy into the cavity 100. The cavity may also include an additional number of radiant heat elements 136 positioned along the side wall of the cavity 100 above and below the partition 122. These heat elements 136 may be located adjacent the partition 122 such that when the partition is inserted into the cavity 100—the heat elements 136 are position in the bottom corners of the upper sub-cavity 124 and the upper corners of the lower sub-cavity 126. By positioning radiant heat elements in the corners of the sub-cavities is it possible to achieve desirable angle of heat input—as shown by arrows 140. The operation of the radiant heat element 136 may be switched or controlled by the presence of the partition 122 such that these heat elements 136 are only in operation when the partition is in place.

The embodiment of FIG. 14 may also include force air fans and round heaters which are shown but not numbered.

Figure 2:
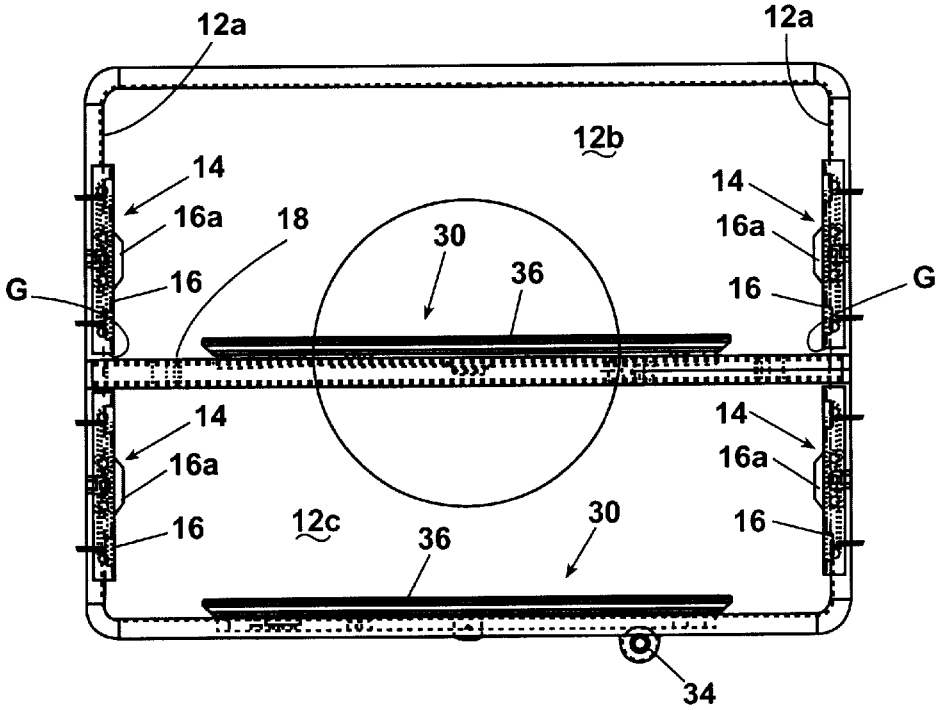
FIG. 2 is a front view of the oven of FIG. 1.
Figure 10:
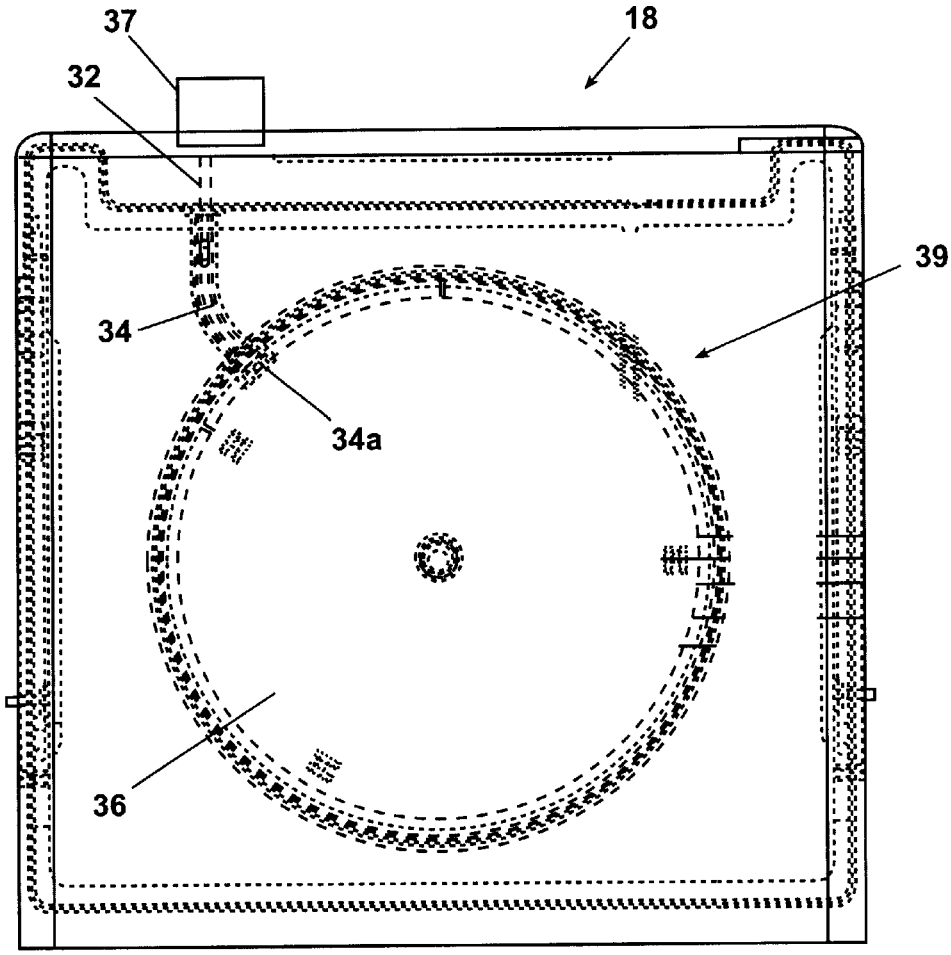
FIG. 10 is a top view of the separating plate with the rotating table thereof.

According to a further embodiment of the invention, the oven can be provided with a turntable or rotating table assembly 30, FIGS. 1, 2 and 10, which may be rotatably supported on the separating plate 18. The rotating table assembly 30 may include a rotating table 36 driven directly by an electric motor. This rotating table assembly is especially useful for further improving cooking performance, better browning and crisping and avoids the need to turn (rotate) the food during cooking.

The turntable assembly 30 may include a drive motor 37 located outside the cavity, a flexible drive shaft 34 having a end with a toothed gear 34*a* and the dish or table 36 equipped with gear teeth on its underside. The drive mechanism can be either direct with a solid shaft or direct with a flexible shaft—as shown in FIG. 10. The drive is connected to the rotating table 36 which can be made part of the above mentioned separating plate 18.

It is possible to use more than one turntable 30 at a time via a replicated drive mechanism. In the embodiment shown in FIGS. 1 and 2, a second rotating plate 30 is shown on the bottom wall of the oven.

Figure 15:
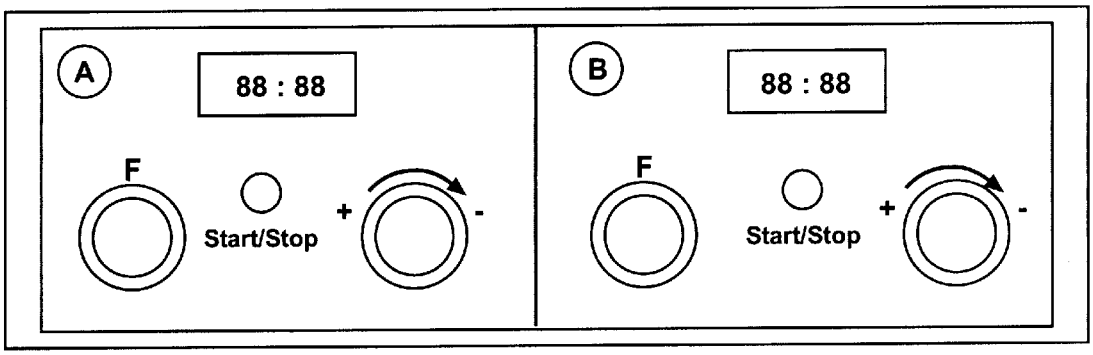
FIG. 15 is an illustration of a user interface for the present invention.

For controlling the operation of the two sub-cavities 12*b* and 12*c*, the oven according to the invention is provided with twin standard controls, shown in FIG. 15. A possible configuration of the control panel of the oven has a right hand control for the standard mode and for the upper sub-cavity mode and a left-hand control for the lower sub-cavity mode—as shown in FIG. 13.

The oven according to the present invention can be used in a standard mode, without the separating plate 18. In this mode the oven can be used as a standard oven (static and/or lower element) or together with the four side heating elements 14, 22, 40 or 50. In this latter case performance (e.g. cooking results) is comparable or better than the standard radial heater configuration (circular heater around fan).

In a second configuration of the oven, called 'flexible cavity' configuration, the separating plate 18 is used to split the oven cavity 12 thus providing three further modes of operation.

In a first mode, only the upper sub-cavity 12*b* is used. In this case the heaters used are the two upper side wall heaters plus the grill element (not shown). The grill element may also be used separately such as for grilling or browning. In such first "flexible" mode the subcavity temperature is set and controlled by the same control used for the standard mode. This mode is particularly suited for meat, poultry, grilling etc.

In a second mode, only the lower sub-cavity 12*c* is used. In this case the heaters used are the two lower side wall heaters plus the lower heating element of the oven (not shown). The lower heating element may also be used separately such as for warming or crisping. In such mode the lower sub-cavity temperature is set and controlled by a sensor positioned in the lower sub-cavity 12*c*. This cavity mode is particularly suited for pasta, cakes, baking, pizza etc.

In a third mode, the sub-cavities 12*b* and 12*c* can be set at 2 different temperatures up to a typical maximum temperature difference of 100° C. e.g. 250° C. for the upper sub-cavity 12*b* and 150° C. for the lower sub-cavity 12*c*. Of course such temperature difference depends on the thermal insulating properties of the separating plate 18 (the lower the heat transfer coefficient, the higher the temperature difference) and degree of sealing.

In all of the above 3 mentioned modes the separating and insulating plate 18 is provided so as to isolate and insulate the two sub-cavities 12*b* and 12*c*. This is done by carefully sizing the separating plate 18 to match the cavity interior profile (incl. oven door) and using a silicone rubber seal (not shown) fitted on the front of the separating plate 18. When in use this latter sits on a suitable ledge defined by the heating elements 14 or by the rails 17 or 28.

When the separating plate 18 is installed the temperature control and sensor of the lower sub-cavity 12*c* is enabled e.g. through a micro-switch (not shown) fitted at the rear of the oven cavity 12.

The separating plate 18 splits the cavity volume in half, i.e. it provides the two sub-activities. Although the separating plate 18 can be removed when installed, its position is preferably fixed.

According to tests carried out by the applicant, in the sub-cavity modes typical warm-up times are at least 30% less than the standard mode (in which the separating plate 18 is removed), thus providing greater flexibility in time management. Typical cooking performance (cooking time) is at least 20% better (less) than the standard oven for the same food or dish. This performance improvement leads to lower energy consumption, lower cooking times, and greater flexibility in use.

In the above description, specific reference has been made to a plurality of different embodiments of the present invention - as contemplated by the inventors. It should be understood, however, that changes may be made to the invention as shown and described above which would still fall within the scope of the appended claims. For example, although repeated reference has been made above to "quartz lamp" type heating elements this should be understood to mean any type of heating element including any type of radiant heating element. Likewise, a reference to a radiant heating element is meant to cover the use of any type of heating element. Other specific descriptions or references should not be used to limit the invention beyond the limitations found in the claims.

We claim:

1. A cooking oven comprising:

an oven cavity;

a separating and insulating plate which can be inserted horizontally in the cavity in order to split it into two sub-cavities having side walls, each sub-cavity having at least a heating element on its side wall.

2. Cooking oven according to claim 1, wherein each side wall of each sub-cavity has at least one heating element.

3. Cooking oven according to claim 1 wherein each heating element is attached to the external face of the cavity side wall.

4. Cooking oven according to claim 1 wherein each heating element is attached to the internal side of the cavity side wall.

5. Cooking oven according to claim 1 wherein each heating element comprises a glass plate mounted in a corresponding opening of the oven cavity and a heater placed on the side of the glass plate opposite from the cavity so that heat is transmitted from the heater to/through the glass and then into the cavity via radiation and convection.

6. Cooking oven according to claim 5 wherein each glass plate is mounted substantially flush to the cavity side wall.

7. A cooking oven comprising:

an oven cavity;

a separating and insulating plate which can be inserted horizontally in the cavity in order to split it into two sub-cavities having side walls, each sub-cavity having at least a heating element on its side wall;

wherein each heating element comprises a glass plate mounted in a corresponding opening of the oven cavity and a heater placed on the side of the glass plate opposite from the cavity so that heat is transmitted from the heater to/through the glass and then into the cavity via radiation and convection, and wherein the heater presents a resistance layout which is flat and has a dickey bow shape so that heat generation is higher toward the oven front door and oven rear wall.

8. A cooking oven comprising:

an oven cavity;

a separating and insulating plate which can be inserted horizontally in the cavity in order to split it into two sub-cavities having side walls, each sub-cavity having at least a heating element on its side wall, wherein each heating element comprises a tubular resistance element cast in a light alloy.

9. A cooking oven comprising:

an oven cavity;

a separating and insulating plate which can be inserted horizontally in the cavity in order to split it into two sub-cavities having side walls, each sub-cavity having at least a heating element on its side wall, wherein each heating element comprises a tubular resistance element clamped to a metallic plate.

10. A cooking oven comprising:

an oven cavity;

a separating and insulating plate which can be inserted horizontally in the cavity in order to split it into two sub-cavities having side walls, each sub-cavity having a heating element on its side wall, wherein said heating elements comprise a pair of twin radiant heating elements located approximately at the center of each side wall, the twin radiant heating element having a top half and a bottom half for forming the heating elements for the respective sub-cavities.

11. Cooking oven according to claim 1 wherein at least one of the heating elements comprises a quartz lamp.

12. Cooking oven according to claim 1 further comprising:

a control unit operably connected to the heating element wherein the control unit is able to independently heat either one of the two sub-cavities or both at the same time, the sub-cavities being able to be set at two different temperatures.

13. Cooking oven according to claim 1, wherein the separating and insulating plate includes a support for a rotating table driven by an electric motor.

14. Cooking oven according to claim 13, wherein the rotating table has a drive mechanism comprising a drive shaft having a gear device able to cooperate with corresponding gear teeth on the underside of the rotating table.

15. A cooking oven comprising:

an oven cavity;

a separating and insulating plate which can be inserted horizontally in the cavity in order to split it into two sub-cavities having side walls, each sub-cavity having at least a heating element on its side wall, wherein the separating and insulating plate is made of a material selected in the group consisting of polymeric material, tempered glass and Pyrex glass.

16. Cooking oven according to claim 1, wherein the oven wall and/or the oven door is coated with a material selected in the group consisting of fluoropolymers, sol-gel generated films and plasma enhanced chemical vapor deposition generated films.

17. A cooking oven comprising:

an oven cavity having a top wall, a bottom wall and opposing side walls for forming a pair of upper corners and a pair of lower corners;

a partition which can be inserted horizontally in the cavity in order to split the oven cavity into an upper sub-cavity and a lower sub-cavity, and at least one heating element located in at least one of the corners of the oven cavity.

18. The cooking oven according to claim 17 further comprising:

four heating elements wherein one heating element is located in each of the four corners of the oven cavity.

19. The cooking oven according to claim 18 wherein each of the heating elements is a radiant type heating element.

20. The cooking oven according to claim 17 further comprising:

a least one side wall heating element located along the side wall of the oven cavity.

21. The cooking oven according to claim 20 further comprising:

a pair of side wall heating elements located on opposite side walls of the oven cavity wherein upon insertion of the partition the side wall heating elements are positioned near the interface between the partition and the side walls of the oven cavity.

22. The cooking oven according to claim 21 wherein the side wall heating elements are radiant type heating elements.

23. A cooking oven comprising:

an oven cavity having a top wall, a bottom wall, a rear wall and opposing side walls;

a partition which can be inserted horizontally in the cavity in order to split the oven cavity into an upper sub-cavity and a lower sub-cavity; and a first fan surrounded by a heating element located along the rear wall within the upper-sub cavity; and a second fan surrounded by a heating element located along the rear wall of the oven cavity in the lower sub-cavity.

24. The cooking oven according to claim 23 further comprising a upper grill element located along the top wall of the oven cavity.

25. The cooking oven according to claim 17 further comprising:

a first pair of side wall heating elements located on a first side wall of the oven cavity and a second pair of side wall heating elements located on the opposite side wall of the oven cavity wherein inserts into the oven cavity separating the pairs of side wall heating elements such that two of the side wall heating elements are positioned above the interface between the partition and the oven cavity and two of the side wall heating elements are positioned below the interface between the partition and the oven cavity.

* * * * *